US007692154B1

(12) United States Patent
Furey et al.

(10) Patent No.: US 7,692,154 B1
(45) Date of Patent: Apr. 6, 2010

(54) LIGHTWEIGHT QUARTIC-SHAPED COLLIMATOR FOR COLLECTING HIGH ENERGY GAMMA RAYS

(75) Inventors: John S. Furey, Vicksburg, MS (US); John C. Morgan, Redwood, MS (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 60 days.

(21) Appl. No.: 12/272,424

(22) Filed: Nov. 17, 2008

(51) Int. Cl.
*G21K 1/02* (2006.01)

(52) U.S. Cl. ..... 250/363.1; 250/505.1

(58) Field of Classification Search ..... 250/363.1, 250/505.1

See application file for complete search history.

(56) References Cited

U.S. PATENT DOCUMENTS

| | | | | |
|---|---|---|---|---|
| 3,865,976 | A * | 2/1975 | Grenier | 178/18.07 |
| 3,943,366 | A | 3/1976 | Platz et al. | |
| 4,081,687 | A * | 3/1978 | York et al. | 378/149 |
| 4,200,803 | A | 4/1980 | Becker et al. | |
| 4,327,293 | A | 4/1982 | Taumann | |
| 4,348,591 | A | 9/1982 | Wunderlich | |
| 4,419,585 | A * | 12/1983 | Strauss et al. | 250/505.1 |
| 4,582,999 | A | 4/1986 | Dance et al. | |
| 5,198,680 | A * | 3/1993 | Kurakake | 250/505.1 |
| 5,212,718 | A | 5/1993 | Casanova | |
| 5,286,973 | A * | 2/1994 | Westrom et al. | 250/253 |
| 5,309,911 | A | 5/1994 | Greiner | |
| 5,436,958 | A | 7/1995 | Taylor | |
| 5,512,754 | A | 4/1996 | Enos | |
| 5,929,447 | A | 7/1999 | Crandall et al. | |
| 6,123,078 | A | 9/2000 | Greiner | |
| 6,730,924 | B1 * | 5/2004 | Pastyr et al. | 250/505.1 |
| 7,250,607 | B1 | 7/2007 | Keck et al. | |
| 2007/0029491 | A1 * | 2/2007 | Olden et al. | 250/370.08 |

* cited by examiner

*Primary Examiner*—David P Porta
*Assistant Examiner*—Jessica L Eley
(74) *Attorney, Agent, or Firm*—Earl H. Baugher, Jr.

(57) ABSTRACT

A collimator incorporating shielding shaped according to the formula $$L_0^2 = y^2 + \left[\frac{y^2 z^2}{(y+D)^2}\right]$$

where y is the minimum thickness of encased shielding needed to shield the collimator from un-collimated radiation entering the collimator at a distance, z, along the longitudinal axis of the collimator, z measured from the bottom of a cylindrical detector, and D is the inner diameter of the collimator as established by the outer diameter of the detector. Select embodiments may be employed for collecting collimated high energy gamma rays from soil using a gamma ray detector.

10 Claims, 2 Drawing Sheets

LIGHTWEIGHT QUARTIC-SHAPED COLLIMATOR FOR COLLECTING HIGH ENERGY GAMMA RAYS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Bea Shahin at 217 373-7234.

BACKGROUND

To collimate with a conventional cylindrical detector of gamma rays, a long hollow tube is surrounded with shielding sufficient to attenuate un-collimated gamma rays. Much work has been done on improving collimators, but mostly for the lower energies used in medical applications (typically 0.511 MeV) and for exotic detectors. For high energy gamma rays (typically 2.6 MeV), such as those emitted from soil and objects in the soil, proper collimation requires an inordinate amount of shielding material on the order of hundreds of pounds of lead shielding.

Select embodiments of the present invention minimize the shielding material required for proper collimation of high energy gamma rays. In select embodiments of the present invention, the weight of shielding is minimized and the collimator tube is portable.

DETAILED DESCRIPTION

Figure 1:
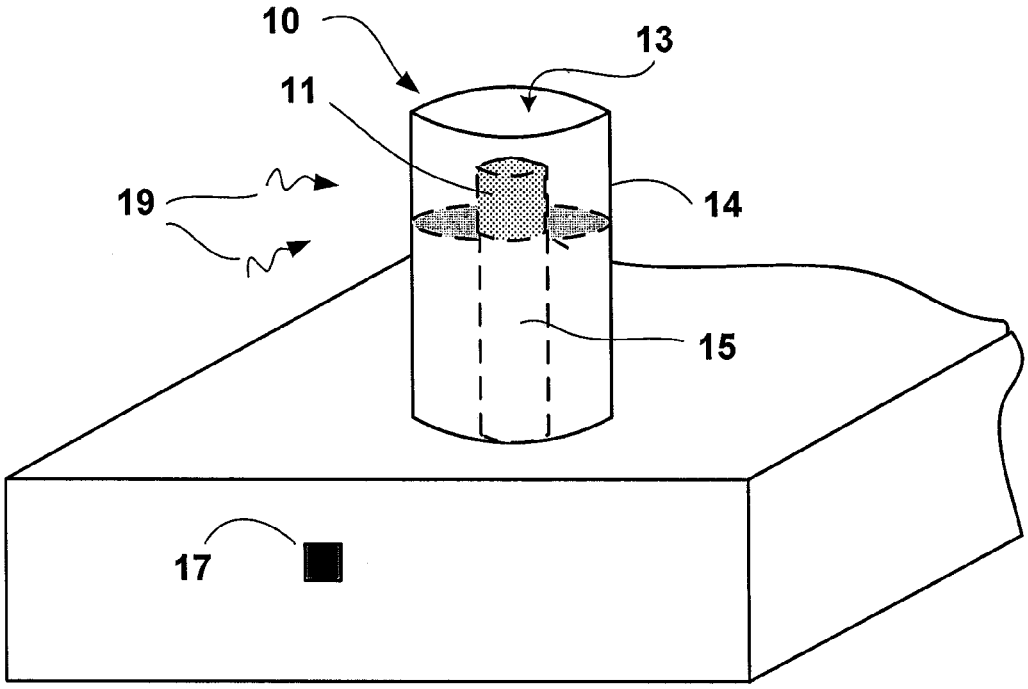
Fig. 1 Prior Art
FIG. 1 is a line drawing of a prior art collimator.

Select embodiments of the present invention envision a lightweight collimator, having a top and a bottom and incorporating shielding about a cylindrical detector having a top and a bottom, the detector affixed near the top of the collimator for collecting collimated radiation through the bottom of the collimator, at least the shielding for collimator shaped externally according to a quartic relationship, $$L_0^2 = y^2 + \left[\frac{y^2 z^2}{(y+D)^2}\right]$$

where y is the minimum thickness of encased shielding needed to shield the collimator from un-collimated radiation entering the collimator at a distance, z, along the longitudinal axis of the collimator, z measured from the bottom of the detector, and D is the inner diameter of the collimator as established by the outer diameter of the detector, such that the collimator has a variable wall thickness that decreases gradually from a thickness $L_0$ at the end of the collimator containing the detector to a thickness, y, measured at a distance, z, away from the bottom of the detector.

In select embodiments of the present invention the shielding is made by machining solid shielding material. In select embodiments of the present invention, the shielding is made by pouring molten shielding material into forms.

In select embodiments of the present invention, the radiation comprises at least gamma rays and the detector is a gamma ray detector.

In select embodiments of the present invention, the shielding material comprises at least in part lead.

Select embodiments of the present invention comprise a method for making a lightweight collimator for collecting radiation, the collimator having at least a top and a bottom, the collimator for collecting collimated radiation through the bottom of the collimator. The method comprises: providing a cylindrical detector, the detector having a top and a bottom, affixing the detector near the top of the collimator; providing a cylindrical tube having an inside diameter of at least the outside diameter of the detector, the tube for collecting the radiation; connecting the cylindrical tube to the bottom of the detector; providing shielding to be incorporated within the collimator and about the detector and the cylindrical tube, at least the shielding to be shaped in accordance with the above quartic relationship; fabricating a configuration to enclose the detector, the shielding, and the tube; and enclosing the detector, the shielding and the tube in the configuration, such that the collimator may be shaped externally according to the quartic relationship by conformally covering the shaped shielding, and such that at least the shielding has a variable wall thickness that decreases gradually from a thickness $L_0$ at the top of the collimator to a thickness, y, measured at a distance, z, away from the bottom of the detector.

In select embodiments of the present invention, the method comprises making the shielding machining solid shielding material. In select embodiments of the present invention, the method comprises making the shielding by pouring molten shielding material into forms shaped in accordance with the above quartic relationship.

In select embodiments of the present invention the method comprises providing as the detector at least one capable of detecting high energy gamma rays. In select embodiments of the present invention the shielding material comprises at least in part lead.

Figure 2:
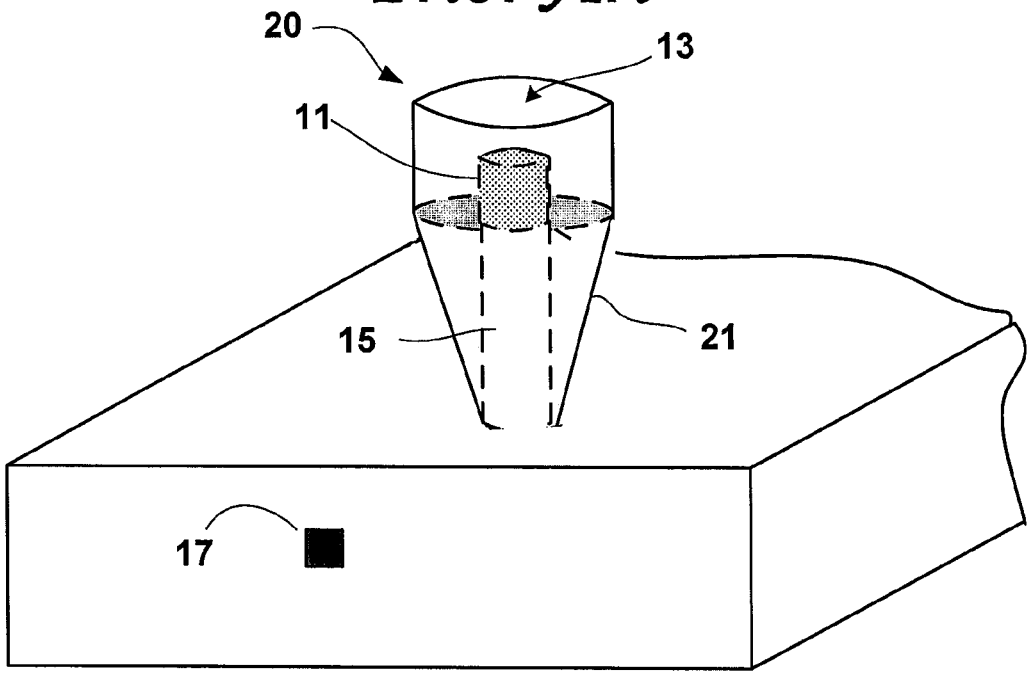
FIG. 2 depicts an embodiment of the present invention in use.

Refer to FIG. 2. Select embodiments of the present invention comprise a shaped collimator 20 having a fixed inner diameter, D, and a variable wall thickness, L, that decreases gradually from a thickness, $L_0$, at the top end of the collimator 20 to a smaller thickness, y, a distance, z, away as measured along the longitudinal axis of the collimator 20, in accordance with the above quartic relationship.

Refer to FIG. 1 depicting a prior art collimator 10. The detector 11 is enclosed in a cylindrical case 14 filled with conventional lead shielding 13. The detector 11 collects gamma rays via a cylindrical collimator tube 15. Some of the collimated gamma rays (not shown separately) from soil and other gamma sources 17 pass directly into the collimator tube 15 and the detector 11. Un-collimated gamma rays 19 can reach the detector 11 only after passing through the shielding 13, thus are blocked. It is desirable for un-collimated gamma rays to be blocked by a sufficient thickness of shielding but the same thickness is not required for portions of the collimator tube 15 remote from the detector 11.

The prior art collimator tube 15 of FIG. 1 employs a full thickness, $L_0$ (FIG. 3), of shielding for the entire length of its case 14. For the portion of the collimator tube 15 not near the detector 11, it is possible for un-collimated gamma rays to be blocked by just the horizontal thickness of the tube 15 and the case 14, and therefore the thickness of the shielding 13 may be reduced at the lower (collection) end of the tube 15.

Refer to FIG. 2, illustrating an embodiment of the present invention, a collimator 20 with a tapered case 21 and a reduced amount of shielding 13. The detector 11 is surrounded by conventional lead shielding 13, but an outer collimator case 21, "tapered" In accordance with a mathematical relationship, reduces the amount of shielding at the "collection" end of the tube 15.

Figure 3:
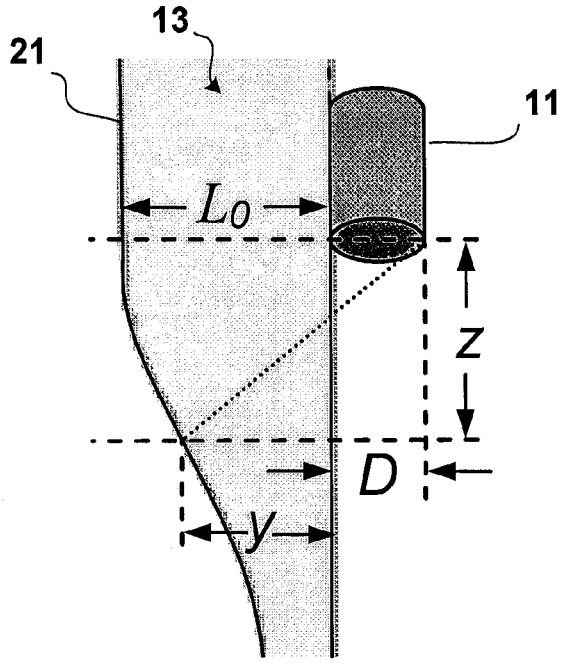
FIG. 3 shows a portion of the longitudinal cross section of an embodiment of the present invention.

Refer to FIG. 3, showing a portion of the longitudinal cross section of the collimator case 21 with detector 11 and shielding 13 installed. The collimator tube 15 has a fixed inner diameter, D, corresponding to the diameter of the detector 11. The thickness of the shielding 13 decreases gradually from a thickness, $L_0$, at the end of the tube 15 attached to the detector 13 to a smaller thickness, y, a distance, z, away as measured along the longitudinal axis of the tube 15, according to the quartic formula given above. The formula establishes the minimum y to attenuate un-collimated gamma rays entering portions of the collimator 20 from its collection point above the soil to the detector 11.

Figure 4:
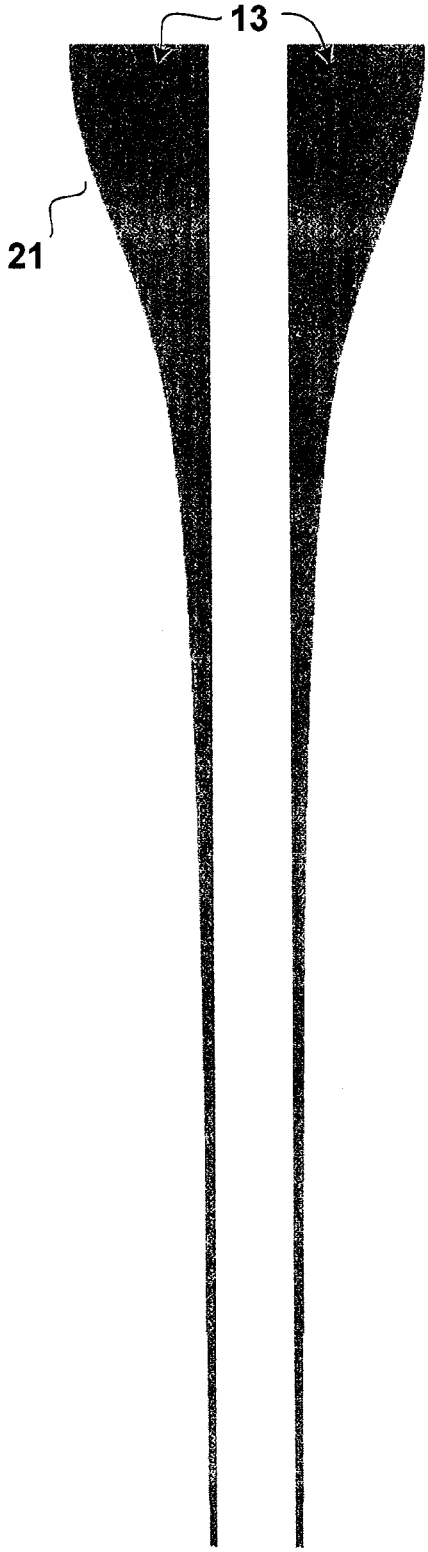
FIG. 4 illustrates the scale of the longitudinal cross section of an embodiment of the present invention.

Refer to FIG. 4, depicting a quartic shape 21 employed with select embodiments of the present invention. For this shape, 82% less shielding 13 is needed than that employed in the prior art shown in FIG. 1. Shown is the actual shape to scale of the longitudinal cross section that may be employed with an embodiment of the present invention. For this embodiment the length of the collimator 20 is 20 times the diameter, D, and the shielding thickness, $L_0$, is 1.9 D.

For select embodiments of the present invention, a collimator 20 may be made by machining solid shielding material to a quartic shape, or alternatively by making quartic-shaped forms into which molten lead is poured. Select embodiments of the present invention are used with a cylindrical detector 11 by attaching the case 21 and shielding 13 in a continuous configuration to parts of the housing of the detector 11. The detector 11 itself may incorporate shielding, e.g., on the back of the detector).

The abstract of the disclosure is provided to comply with the rules requiring an abstract that will allow a searcher to quickly ascertain the subject matter of the technical disclosure of any patent issued from this disclosure. (37 CFR § 1.72(b)). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for reducing the amount of shielding needed for a collimator used to collect gamma rays, it may be used for any type of testing or monitoring and thus may be useful in such diverse applications as structural monitoring, mining, drilling, remediating, environmental intervention, military operations and the like. Structure monitored or tested may be of any type ranging from naturally occurring to manmade. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. A lightweight collimator, having at least a top and a bottom and incorporating shielding about a cylindrical detector having at least a top and a bottom, said detector affixed near said top of said collimator for collecting collimated radiation through said bottom of said collimator, at least said shielding shaped externally according to the quartic relationship:

$$L_0^2 = y^2 + \left[\frac{y^2 z^2}{(y+D)^2}\right]$$

where y is the minimum thickness of encased shielding needed to shield said collimator from un-collimated radiation entering said collimator at a distance, z, along said longitudinal axis of said collimator, z measured from the bottom of said detector, and D is the inner diameter of said collimator as established by the outer diameter of said detector, wherein at least said shielding incorporated in said collimator has a variable wall thickness that decreases gradually from a thickness $L_0$ at the end of said collimator containing said detector to a thickness, y, measured at a distance, z, away from the bottom of said detector.

2. The collimator of claim 1 made by machining solid shielding material.

3. The collimator of claim 1 made by pouring molten shielding material into forms shaped in accordance with said quartic relationship.

4. The collimator of claim 1 in which said radiation comprises at least gamma rays and said detector is at least a gamma ray detector.

5. The collimator of claim 4 in which said shielding material comprises at least in part lead.

6. A method for making a lightweight collimator for collecting radiation, said collimator having at least a top and a bottom, said collimator for collecting collimated radiation through said bottom of said collimator, comprising:

providing a cylindrical detector, said detector having at least a top and a bottom, wherein said detector is affixed near said top of said collimator;

providing a cylindrical tube having an inside diameter of at least the outside diameter of said detector, said tube for collecting said radiation;

connecting said cylindrical tube to said detector so as to be in operable communication with said bottom of said detector;

providing shielding to be incorporated within said collimator and about said detector and said cylindrical tube, at least said shielding to be shaped in accordance with the quartic relationship:

$$L_0^2 = y^2 + \left[\frac{y^2 z^2}{(y+D)^2}\right]$$

where y is the minimum thickness of encased shielding needed to shield said collimator from un-collimated radiation entering said collimator at a distance, z, along said longitudinal axis of said collimator, z measured from the bottom of said detector, and D is the inner diameter of said collimator as established by the outer diameter of said detector;

fabricating a configuration to enclose said detector, said shielding, and said tube; and enclosing said detector, said shielding and said tube in said configuration, wherein said collimator is shaped externally according to said quartic relationship, and wherein at least said shielding material has a variable wall thickness that decreases gradually from a thickness $L_0$ at said top of said collimator to a thickness, y, measured at a distance, z, away from said bottom of said detector.

7. The method of claim 6 said shielding made by machining solid shielding material.

8. The method of claim 6 said shielding made by pouring molten shielding material into forms shaped in accordance with said quartic relationship.

9. The method of claim 6 said radiation comprising at least gamma rays and said detector comprising at least a gamma ray detector.

10. The method of claim 9 said shielding material comprising at least in part lead.

* * * * *